US008708455B2

(12) United States Patent
Tamaki

(10) Patent No.: US 8,708,455 B2
(45) Date of Patent: Apr. 29, 2014

(54) CAPPING DEVICE AND LIQUID EJECTION APPARATUS

(75) Inventor: Shuichi Tamaki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 470 days.

(21) Appl. No.: 12/892,901

(22) Filed: Sep. 28, 2010

(65) Prior Publication Data

US 2011/0128322 A1 Jun. 2, 2011

(30) Foreign Application Priority Data

Nov. 27, 2009 (JP) ..... 2009-270527

(51) Int. Cl.
*B41J 2/165* (2006.01)

(52) U.S. Cl.
USPC ..... 347/32; 347/29

(58) Field of Classification Search
USPC ..... 347/29, 32
See application file for complete search history.

(56) References Cited

U.S. PATENT DOCUMENTS

| | | | |
|---|---|---|---|
| 2007/0146413 | A1 | 6/2007 | Ha |
| 2008/0198196 | A1 | 8/2008 | Chikamoto |
| 2009/0015627 | A1 | 1/2009 | Takahashi |

FOREIGN PATENT DOCUMENTS

| | | | |
|---|---|---|---|
| CN | 1986232 | A | 6/2007 |
| CN | 101244652 | A | 8/2008 |
| EP | 1462259 | A2 | 9/2004 |
| JP | H07-056741 | A | 3/1995 |
| JP | H08-224880 | A | 9/1996 |
| JP | 11314628 | A * | 11/1999 |
| JP | 2004-284208 | A | 10/2004 |

OTHER PUBLICATIONS

The Derwent Abstract of JP 11-314628 A. Publication date of JP 11-314628 A is Nov. 16, 1999.*

Translation of JP 2004-284208 A. (JP 2004-284208 A was published on Oct. 14, 2004).*

The State Intellectual Property Office of the People's Republic of China, Notification of the First Office Action for Chinese Patent Application No. 201010516384.4 (counterpart Chinese patent application), issued Dec. 4, 2012.

European Patent Office, extended European Patent Application No. 10010215.1 (counterpart to above-captioned patent application), dated Apr. 4, 2012.

Japan Patent Office, Notification of Reason for Refusal for Japanese Patent Application No. 2009-270527 (counterpart Japanese patent application), mailed Feb. 12, 2013.

* cited by examiner

*Primary Examiner* — Justin Seo
(74) *Attorney, Agent, or Firm* — Baker Botts L.L.P.

(57) ABSTRACT

A capping device including: (a) a cap structure is movable, relative to an object, in a contact direction toward a surface of the object so as to be brought into contact with the surface, for thereby covering the surface of the object; (b) a transmission mechanism configured to transmit, to the cap structure, a pressing force that causes the cap structure to be brought into contact with the surface; and (c) a support member supporting the transmission mechanism. The transmission mechanism is configured to restrain increase and reduction of the pressing force, such that the pressing force transmitted to the cap structure is held in a given amount range at least when a distance between the cap structure and the support member in the contact direction is in a given distance range while the cap structure is in contact with the surface.

13 Claims, 8 Drawing Sheets

SUB-SCANNING DIRECTION

MAIN SCANNING DIRECTION

CAPPING DEVICE AND LIQUID EJECTION APPARATUS

CROSS REFERENCE TO RELATED APPLICATION

This application claims priority from Japanese Patent Application No. 2009-270527 filed on Nov. 27, 2009, the disclosure of which is herein incorporated by reference in its entirety.

BACKGROUND OF THE INVENTION

1. Field of the Invention

The present invention relates to a capping device configured to cover a surface such as an ejection-outlet opening surface of a liquid ejection head for ejecting liquid droplets, and also to a liquid ejection apparatus.

2. Discussion of Related Art

There is known an inkjet printer including a cap member that is configured to cap or cover a nozzle opening surface of an inkjet head of the inkjet printer, so as to avoid ink within nozzles (that open in the nozzle opening surface) from being dried and prevent increase of viscosity of the ink within the nozzles. For enabling the cap member to assuredly covering the nozzle opening surface, the cap member has to be brought into close contact with the nozzle opening surface. In this respect, there is known a technique for supporting a cap holder by means of a spring, so as to force the cap member held by the cap holder, against the nozzle opening surface.

SUMMARY OF THE INVENTION

An elastic force generated by an elastic body such as a spring varies depending on change of its length (spring length). This means that the elastic force varies inevitably due to variation (e.g., error) in positioning of the cap holder relative to the nozzle opening surface. Therefore, in the prior art technique, there is a case where the cap member is pressed against the nozzle opening surface by a pressing force that is excessively increased whereby the cap member and the nozzle opening surface could be abnormally deformed thereby disabling the cap member to accurately cover the nozzle opening surface. Further, in the prior art technique, there is a case where the pressing force is insufficient for establishing a sufficient degree of tightness between the cap member and the nozzle opening surface, thereby making it impossible to sufficiently prevent the ink within the nozzle from being dried. The present invention was made in view of such a background. It is therefore a first object of the invention to provide a capping device in which a cap structure can be stably pressed against a surface (that is to be covered) by a desired pressing force. A second object of the invention is to provide a liquid ejection apparatus including the capping device.

The first object of the invention may be achieved by a first aspect of the invention, which provides a capping device including: (i) a cap structure that is to be movable, relative to an object, in a contact direction toward a surface of the object so as to be brought into contact with the surface, for thereby covering the surface of the object; (ii) a transmission mechanism configured to transmit, to the cap structure, a pressing force that causes the cap structure to be brought into contact with the surface; (iii) a support member that supports the transmission mechanism; and (iv) the transmission mechanism being configured to restrain increase and reduction of the pressing force, such that the pressing force transmitted to the cap structure is held in a given amount range at least when a distance between the cap structure and the support member in the contact direction is in a given distance range while the cap structure is in contact with the surface. It is noted that the support member may include a pressing-force receiving portion at which the pressing force is to be received by the support member.

The second object of the invention may be achieved by a second aspect of the invention, which provides a liquid ejection apparatus including: (a) an liquid ejection head including an ejection-outlet opening surface in which ejection outlets open such that liquid is to be ejected from the liquid ejection head through the ejection outlets; (b) the capping device recited in the above-described first aspect of the invention, such that the cap structure is to be brought into contact with the ejection-outlet opening surface as the surface of the object; and (c) each of at least one of the liquid ejection head and the support member being movable relative to the other of the liquid ejection head and the support member in the contact direction.

BRIEF DESCRIPTION OF THE DRAWINGS

The above and other objects, features, advantages and technical and industrial significance of the present invention will be better understood by reading the following detailed description of presently preferred embodiment of the invention, when considered in connection with the accompanying drawings, in which.

DETAILED DESCRIPTION OF THE PREFERRED EMBODIMENT

There will be described a preferred embodiment of the invention, with reference to the drawings.

Figure 1:
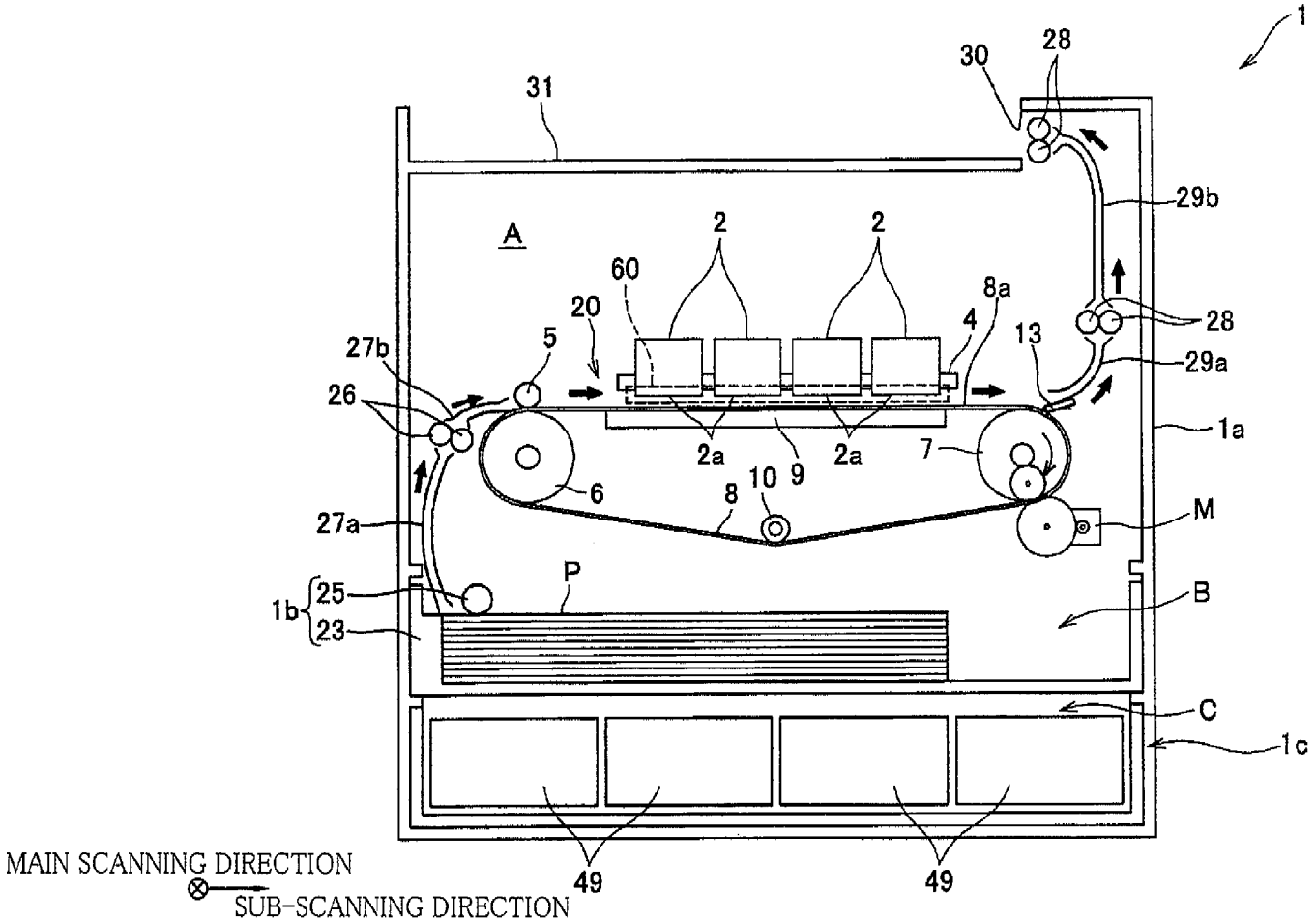
FIG. 1 is a view schematically showing an internal construction of an inkjet printer according to an embodiment of the invention.

As shown in FIG. 1, the inkjet printer 1 has a generally rectangular-shaped casing body 1*a*. A sheet exit portion 31 is provided in an upper portion of the casing body 1*a*. An inner space within the casing body 1*a* is sectioned into three space sections A, B, C that are arranged in this order of description as seen from top to bottom. In the space section A, there are provided a sheet conveying unit 20, a capping device 60 (see FIG. 2) and four inkjet heads 2 which are respectively assigned to eject inks of magenta, cyan, yellow and black. In the space section B, there is provided a sheet supply unit 1*b* including a sheet supply tray 23 that is detachably installed in the casing body 1*a*. In the space section C, there is provided an ink tank unit 1*c*. In the present embodiment, a sub-scanning direction is a direction parallel to a sheet conveying direction in which paper sheets P are to be conveyed in the sheet conveying unit 20, while a main scanning direction is a direction which is orthogonal to the sub-scanning direction and which is parallel to a horizontal plane.

In the inkjet printer 1, there is defined a sheet conveying path (indicated by bold arrows in FIG. 1) along which the sheets P are to be conveyed from the sheet supply unit 1*b* toward the sheet exit portion 31. The sheet supply unit 1*b* has a sheet supply tray 23 and a pick-up roller 25 that is attached to the sheet supply tray 23. The sheet supply tray 23 is capable of storing therein a plurality of paper sheets P. The pick-up roller 25 is configured to pick up an uppermost one of the sheets P stacked on the sheet supply tray 23. The sheet P, which has been picked up by the pick-up roller 25, is supplied to the sheet conveying unit 20, while being guided by guides 27*a*, 27*b* and gripped by a pair of feed rollers 26.

The sheet conveying unit 20 has two belt rollers 6, 7, a conveyor belt 8 that is an endless belt, and a tension roller 10. The conveyor belt 8 is stretched around the two belt rollers 6, 7 and the tension roller 10. The tension roller 10 is located on a lower side of a straight line passing through axes of the respective belt rollers 6, 7, and is held in contact with an inner circumferential surface of the conveyor belt 8. The tension roller 10 is biased or forced upwardly whereby the conveyor belt 8 is given a tension by the tension roller 10. The belt roller 7 as a drive roller is given a drive force that is transmitted from a conveyor motor M via two gears, whereby the belt roller 7 is rotated in clockwise direction as seen in FIG. 1. The belt roller 6 as a driven roller is rotated in clockwise direction as seen in FIG. 1, as the conveyor belt 8 is circulated by rotation of the belt roller 7.

The conveyor belt 8 has an outer circumferential surface 8*a* that is coated with a silicon coating so as to have stickiness. A nip roller 5 is disposed on a position which lies on a sheet conveying path, and which is located on one of opposite sides of the conveyor belt 8 that is remote from the belt roller 8. The nip roller 5 serves to force the sheet P (that has been supplied from the sheet supply unit 1*b*) against the outer circumferential surface 8*a* of the conveyor belt 8. The sheet P, which is pressed against the outer circumferential surface 8*a*, is conveyed in rightward direction as seen in FIG. 1, while being held on the outer circumferential surface 8*a*, owing to the stickiness.

A separator plate 13 is disposed on a position which lies on the sheet conveying path, and which is located on one of opposite sides of the conveyor belt 8 that is remote from the belt roller 7. The separator plate 13 serves to separate the sheet P (that is held on the outer circumferential surface 8*a* of the conveyor belt 8) from the outer circumferential surface 8*a*. The sheet P, which has been separated by the separator plate 13, is further conveyed by two pairs of discharge rollers 28. The sheet P is gripped by the discharge rollers 28 while being guided by guides 29*a*, 29*b*, so as to be further conveyed along the sheet conveying path, and is discharged to a sheet exit portion 31 via an opening 30 that is provided on an upper portion of the casing body 1*a*.

The four inkjet heads 2, each of which is elongated in the main scanning direction, are arranged in the sheet conveying direction. The four inkjet heads 2 are fixed to the frame 4, such that the inkjet heads 2 are located in respective positions that are adjacent to each other in the sheet conveying direction. Each of the four inkjet heads 2 has a lower surface 2*a* that serves as a nozzle opening surface 2*a* as an example of an ejection-outlet opening surface, such that liquid can be ejected through ejection outlets opening in the ejection-outlet opening surface, namely, such that ink droplets can be ejected through nozzles that open in the nozzle opening surface 2*a*. The inkjet printer 1 is a line-type color inkjet printer in which each inkjet head 2 is operable to eject the ink droplets of an assigned one of the colors (magenta, cyan, yellow and black) within an ink ejection area that is elongated in the main scanning direction.

As shown in FIG. 1, a platen 9 is disposed inside a loop defined by the conveyor belt 8, and is located in a position that is opposed to the four inkjet heads 2. An upper surface of the platen 9 is in contact with the inner circumferential surface of an upper-loop portion of the conveyor belt 8 which defines an upper portion of the loop. The outer circumferential surface 8*a* of the upper-loop portion of the conveyor belt 8 and the nozzle opening surface 2*a* of each inkjet head 2 are held in parallel with each other, and are opposed to each other with a small clearance being defined therebetween. This small clearance constitutes a part of the sheet conveying path. Each of the inkjet heads 2 is operated to eject the ink droplets of the assigned color, toward an upper surface of the sheet P, when the sheet P passes right below the inkjet head 2. That is, as the sheet P held on the outer circumferential surface 8*a* of the conveyor belt 8 is conveyed, the inkjet heads 2 are sequentially operated to eject the ink droplets of the assigned colors, whereby a desired color image can be formed on the sheet P.

The frame 4 is vertically movable by a frame movement mechanism (not shown). Normally, the frame 4 is positioned in a printing position in which the four inkjet heads 2 are to be operated to eject the ink droplets toward the sheet P. However, the frame 4 is positioned in a capping position that is located on an upper side of the printing position, when a capping operation is carried out for capping or covering the nozzle opening surfaces 2*a* of the respective inkjet heads 2.

Each of the inkjet heads 2 is connected, via a tube (not shown), to a corresponding one of ink tanks 49 that are disposed in the ink tank unit 1*a*. Each of the ink tanks 49 stores therein the ink of a corresponding one of the colors which is to be ejected by the corresponding inkjet head 2. The ink is supplied from each of the ink tanks 49 to the corresponding inkjet head 2 via the tube.

Figure 2:
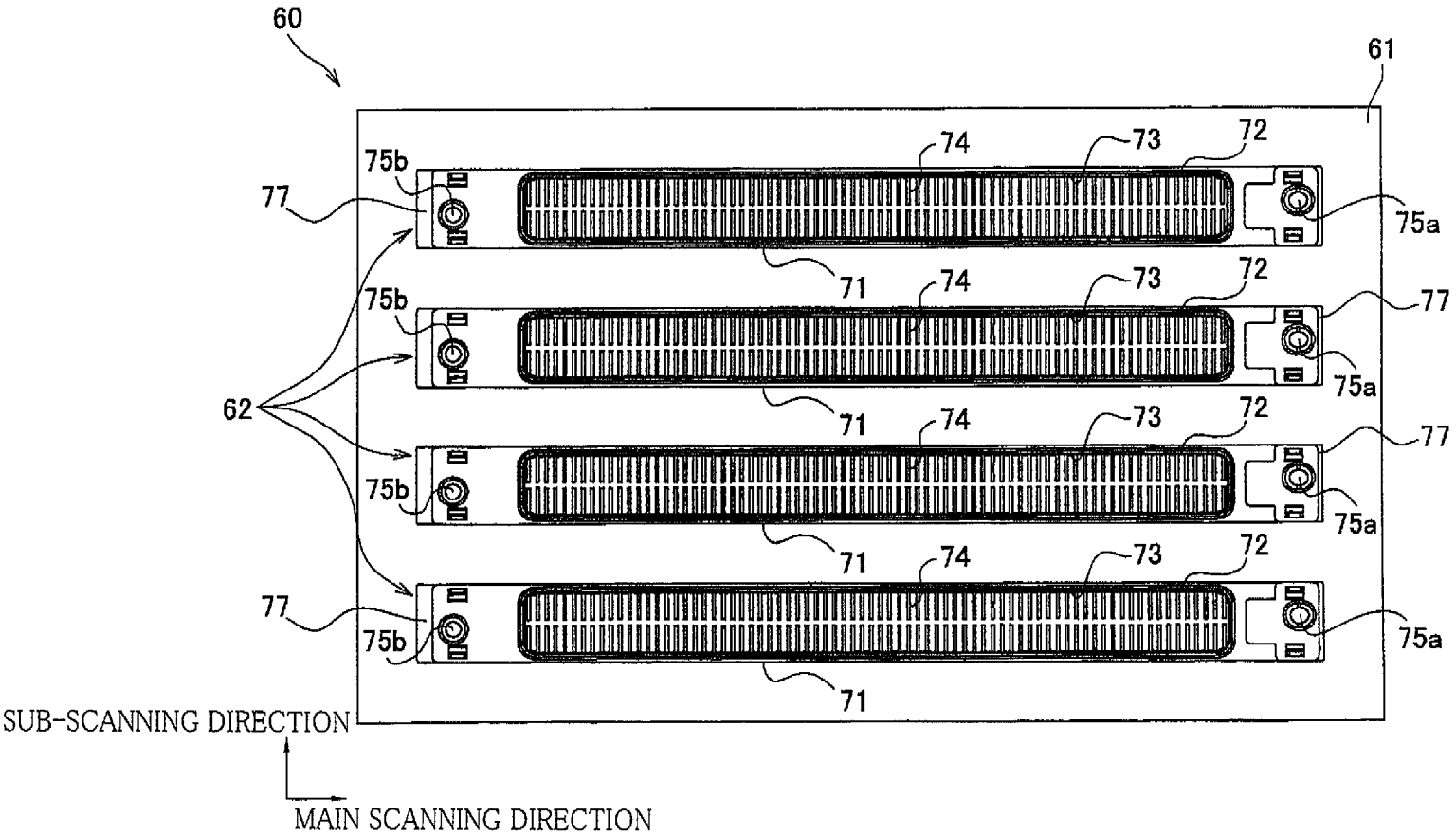
FIG. 2 is a plan view showing a capping device included in the inkjet printer of FIG. 1.

There will be next described a capping device 60 that is operable to cap or cover the nozzle opening surfaces 2*a* of the respective inkjet heads 2. During a printing operation, the capping device 60 is positioned in a non-capping position (i.e., non-operating position) that is located on a rear side of the inkjet heads 2 (as seen in FIG. 1). During the capping operation, the capping device 60 is positioned in a capping position (i.e., operating position), so as to be opposed to the inkjet heads 2. As shown in FIG. 2, the capping device 60 has a tray 61 and four capping units 62 that are fixed to the tray 61. The tray 61 is movable in the main scanning direction by a tray movement mechanism (not shown). The four capping units 62 are arranged in the sub-scanning direction, such that the four capping units 62 are opposed to the respective four inkjet heads 2 when the capping device 60 is positioned in the capping position.

Figure 3:
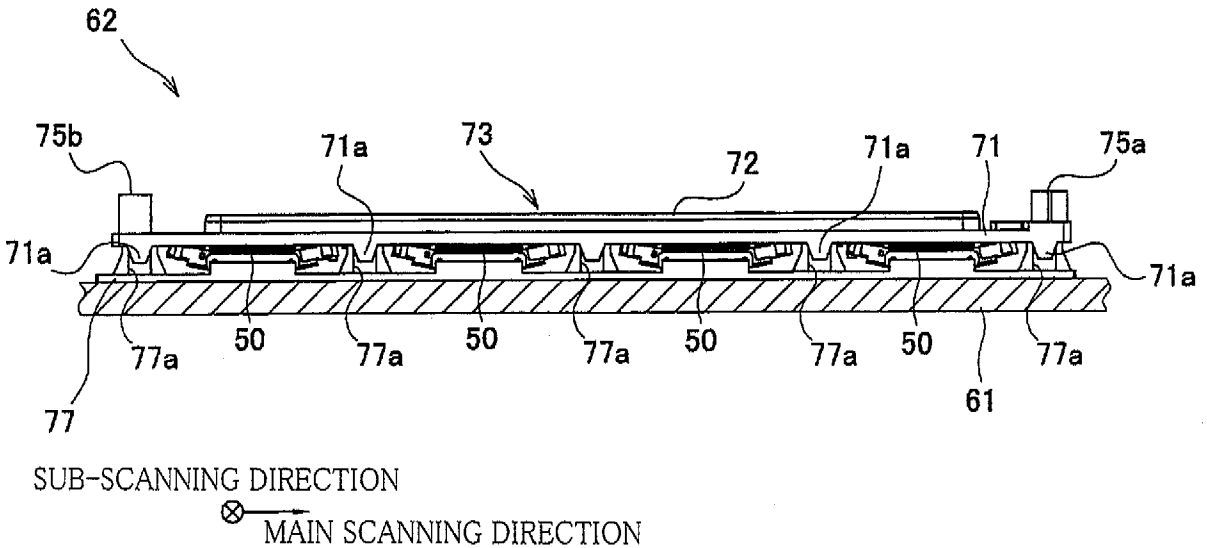
FIG. 3 is a side view, partially in cross section, showing a capping unit included in the capping device of FIG. 2.

As shown in FIGS. 2 and 3, each of the capping units 62 has a cap member 72, a holder 71, four transmission mechanisms 50 and a fixture plate 77. The cap member 72 and the holder 71 cooperate with each other to constitute a cap structure. The fixture plate 77 constitutes a support member. The cap member 72 is made of rubber, resin or other elastically deformable material, and is provided for capping or covering the nozzle opening surface 2*a* of the corresponding inkjet head 2. The cap member 72 includes a bottom plate portion 72*a* and a frame-like shaped protrusion 72*b* (see FIG. 7). The bottom plate portion 72*a* has substantially a rectangular shape, and is elongated in the main scanning direction. The protrusion 72*b* protrudes from the bottom plate portion 72*a*. The protrusion 72*b* has a plan configuration that makes it possible to surround at least the ink ejection area of the nozzle opening surface 2*a* of the corresponding inkjet head 2. The bottom plate portion 72*a* and the frame-like shaped protrusion 72*b* cooperate to define a recess 73. A cap chip 74 is disposed on a bottom of the recess 73, and has a multiplicity of grooves each of which is elongated in the sub-scanning direction. The grooves formed in the cap chip 74 are arranged in two rows each extending in the main scanning direction. The ink, which has been discharged into the recess 73, is caused to flow along the grooves of the cap chip 74 and to be discharged outside the cap unit 62 through a discharge port (not shown) of the cap chip 74 and a discharge passage (not shown) of the cap member 72.

The holder 71 is a reinforcement member made of resin, and is provided to hold the cap member 72 from its lower side. The holder 71 has positioning holes 75, 75*b* which open in its upper surface and which are located in respective end portions of the holder 71 that are opposite to each other in the main scanning direction. Into the positioning holes 75, 75*b*, respective positioning pins 2*b* (see FIG. 7) of the inkjet head 2 are introduced in the capping operation, so as to accurately position the cap member 72 relative to the nozzle opening surface 2*a* of the inkjet head 2. The positioning pins 2*b* are provided on the inkjet head 2, and are located on respective sides of the nozzle opening surface 2*a* that are opposite to each other in the main scanning direction. Further, the holder 71 has five protrusions which are arranged in a row extending in the main scanning direction and which are spaced apart from each other by a predetermined pitch in the main scanning direction (see FIG. 3). Each of the five protrusions protrudes downwardly from a lower surface of the holder 71. A hook 71*a* is provided in a distal end portion of each of the five protrusions.

The fixture plate 77, which is a plate member made of resin, is fixed to the tray 61 and is opposed to the holder 71. The fixture plate 77 has a bottom surface that serves as a pressing-force receiving portion configured, during the capping operation, to receive a pressing force (as a reaction of a pressing force applied from the nozzle opening surface 2*a* to the cap member 72) which is applied thereto from the tray 61. Further, the fixture plate 77 has five guide portions 77*a* which are arranged in a row extending in the main scanning direction and which are spaced apart from each other by the predetermined pitch in the main scanning direction (see FIG. 3). Each of the five guide portions 77*a* is opposed to a corresponding one of the above-described five protrusions, and protrudes upwardly from an upper surface of the fixture plate 77. In each of the five guide portions 77*a*, there is provided a hole which vertically extends and which has a rectangular shape (see FIG. 7), such that the hook 71*a* of a corresponding one of the above-described five protrusions is engaged in the hole. The hook 71*a* is vertically slidable in the hole of the guide portion 77*a*, whereby the holder 71 is vertically movable relative to the fixture plate 77. The movement of the holder 71 away from the fixture plate 77 is limited by contact of the hook 71*a* with an upper end of the hole of the guide portion 77*a* (see FIG. 7).

Figure 4A:
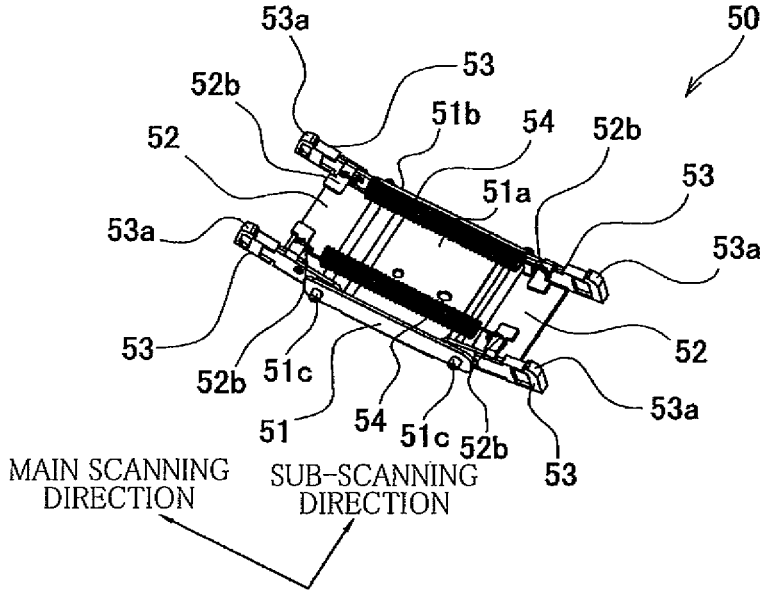
FIG. 4A is a perspective view showing a transmission mechanism included in the capping unit of FIG. 3.
Figure 4B:
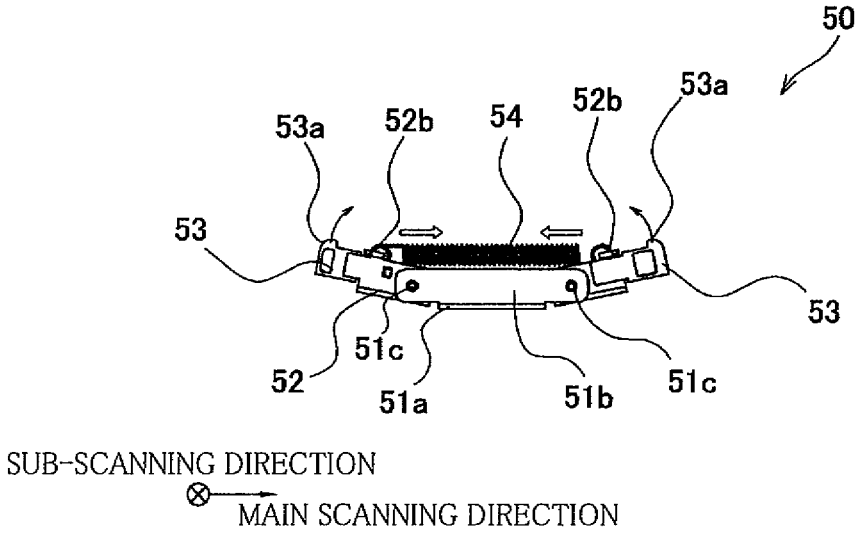
FIG. 4B is a side view showing the transmission mechanism.

The four transmission mechanisms 50 are arranged in the main scanning direction while being gripped between the fixture plate 77 and the holder 71. As shown in FIGS. 4A and 4B, each of the transmission mechanisms 50 has a frame 51, a pair of pivot members 52 and two coil springs 54 as elastic members. The frame 51 has a bottom plate 51*a* at which the frame 51 is fixed to the fixture plate 77. The frame 51 has a pair of side plates 51*b* which are elongated in the main scanning direction and which extend upwardly from respective end portions of the bottom plate 51*a* that are opposite to each other in the sub-scanning direction. Two shafts 51*c*, which extend in the sub-scanning direction (that is held in parallel with the nozzle opening surface 2*a* during the capping operation), are fixed at their longitudinally opposite end portions to the side plates 51*b*. One of the two shafts 51*c* is fixed to one of end portions of each side plate 51*b* which are opposite to each other in the main scanning direction. The other of the two shafts 51*c* is fixed to the other of the end portions of each side plate 51*b* which are opposite to each other in the main scanning direction.

The pair of pivot members 52 are disposed on respective sides of the frame 51 in the main scanning direction, and are opposed to each other in the main scanning direction. Each of the pivot members 52 has generally a U shape in its cross section, and is pivotable relative to the frame 51 about the shaft 51*c* which pierces proximal end portions of respective side walls of the pivot member 52. A contact member 53 is fixed to each of distal end portions of the respective side walls of the pivot member 52. The contact member 53 has, in its distal end portion, a cam portion 53*a* which has a given cam profile and which is held in slidable contact with a contact surface 71*b* that is constituted by a bottom surface of the holder 71 (see FIG. 5). The pivot member 52 is pivotable within a range defined by a range of vertical movement of the holder 71 relative to the fixture plate 77. Each of the pivot members 52 has two cam portions 53*a* so that each of the four transmission mechanisms 50 has a total of four cam portions 53*a*. Therefore, a total of sixteen cam portions 53*a* of the four transmission mechanism 50 are held in contact with the contact surface 71*b* of the holder 71. It can be considered that each cam portion 53*a* cooperates with the contact surface 71*b* of the holder 71 to constitute a cam mechanism. As shown in FIG. 3, among the sixteen cam portions 53*a*, twelve cam portions 53*a* (that are other than four cam portions 53*a* corresponding to endmost ones of the cam portions 53*a* in the main scanning direction) are located in respective positions opposed to the frame-like protrusion 72*b* of the cap member 72. It is noted that each of the twelve cam portions 53*a* does not necessarily have to be located in respective positions precisely aligned with the frame-like protrusion 72*b* but may be located in respective positions that are adjacent to the precisely aligned positions.

As shown in FIGS. 4A and 4B, the two coil springs 54 are tensile springs interconnecting the pair of pivot members 52 that are opposed to each other in the main scanning direction. Each of the two coil springs 54 is connected at its opposite end portions to spring supporting portions 52*b* that are provided in intermediate portions of the side walls of the respective pivot members 53, such that the pivot members 53 are biased or forced to be pivoted toward each other, by a contractive force generated by each of the two coil springs 54, as shown in FIG. 4B. Thus, upon change of the distance between the holder 71 and the fixture plate 77, the pivot members 52 are pivoted in respective directions that are different from each other, while maintaining a symmetrical positional relationship between the pivot members 52, namely, while theirs positions are held to be symmetrical with each other with respect to a vertical plane that interconnects centers of the respective two coil springs 54.

Figure 5:
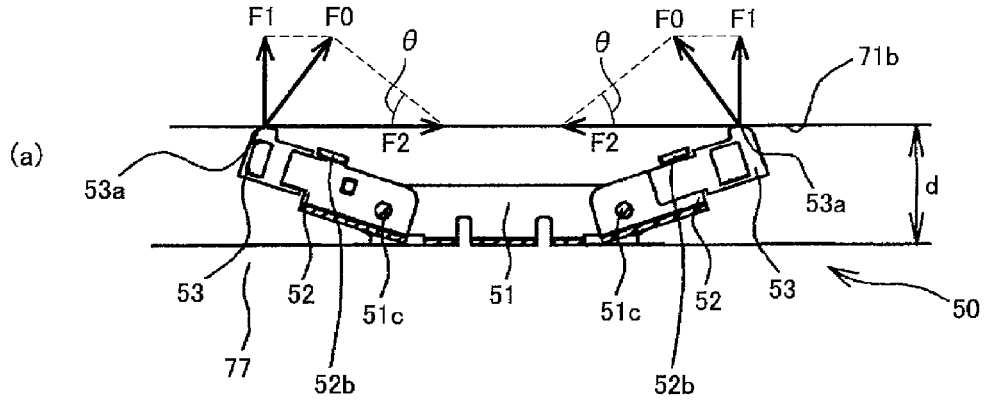
FIG. 5 is a set of views showing operation of the transmission mechanism.
Figure 5:
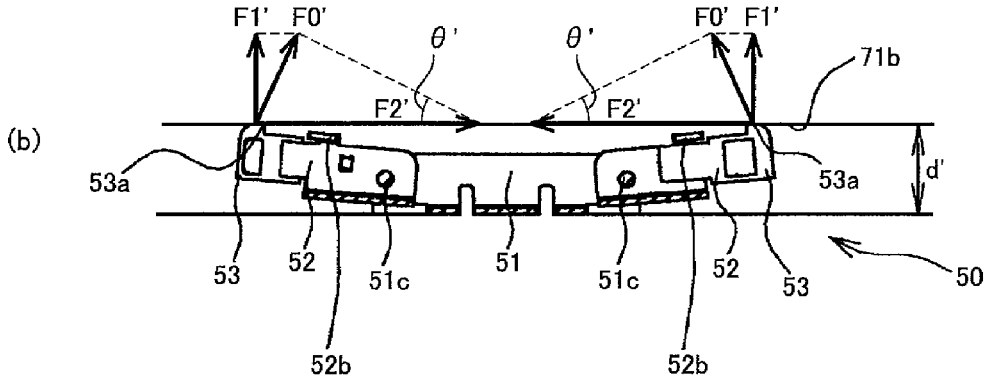

As shown in FIG. 5, irrespective of whether the capping operation is being carried out or not, a fulcrum-load line and a surface-parallel line cooperate to define therebetween an angle that is not larger than 45°, wherein the spring supporting portion 52*b* serves as an effort point, wherein the fulcrum-load line passes through a fulcrum point (corresponding to a center of the shaft 51*c*) and a load point (at which the cam portion 53*a* is in contact with the contact surface 71*b*), wherein the surface-parallel line passes through the load point and a point which lies on a parallel plane and which is the closest to the fulcrum point, and wherein the parallel plane contains the load point and is parallel with the nozzle opening surface 2*a*. The elastic force generated by the coil spring 54 is increased with elongation of the coil spring 54. When each of the pivot members 52 is pivoted in a direction that reduces inclination of the fulcrum-load line with respect to the nozzle opening surfaces 2*a*, the length of the coil spring 54 is increased whereby the elastic force generated by the coil spring 54 is increased.

The pair of pivot members 52 are biased or forced by the two coil springs 54, whereby the cam portions 53*a* of the respective pivot members 52 can be moved upwardly and toward inside of the transmission mechanism 50, describing circular arcs. When the cam portions 53*a* are moved upwardly and toward the inside of the transmission mechanism, the cam portions 53*a* upwardly presses the holder 71 while being slid on the contact surface 71*b* of the holder 71 toward the inside of the transmission mechanism 50, i.e., toward a center of the transmission mechanism 50 in the main scanning direction. Since the holder 71 is forced or pressed upwardly pressed by the cam portions 53*a* of the respective pivot members 52, the holder 71 is moved upwardly whereby the distance between the cap member 72 and the fixture plate 77 is increased. Thus, the pair of pivot members 52 are biased or forced, by the two coil springs 54, so as to be pivoted in respective directions that increase the distance between the cap member 72 and the fixture plate 77.

During the capping operation, when the cap member 72 is pressed by the nozzle opening surface 2*a*, the bottom surface of the fixture plate 77, which serves as the pressing-force receiving portion, receives a pressing force as a reaction of the pressing force applied from the nozzle opening surface 2*a* to the cap member 72. Owing to the pressing force received by the pressing-force receiving portion, the distance between the contact surface 71*b* and the fixture plate 77 is reduced from a distance value d to a distance value d' (that is smaller than the value d), and the pivot members 52 are pivoted in respective directions away from each other, such that the inclination of the above-described fulcrum-load line with respect to the nozzle opening surfaces 2*a* is reduced, and such that the inclination of a fulcrum-effort line (passing through the fulcrum point and the effort point) with respect to the nozzle opening surface 2*a* is also reduced. As a result of the pivot motions of the pivot members 52 in the respective directions away from each other, a distance between the effort point on one of the pivot members 52 and the effort point on the other of the pivot members 52 is increased whereby the elastic force generated by the coil spring 54 is increased from a force F2 to a force F2'. Further, the cam portions 53*a* of the respective pivot members 52 are slidingly moved relative to the contact surface 71*b*, such that the point (i.e., load point), at which the cam portion 53*a* of each pivot member 52 is in contact with the contact surface 71*b*, is moved in a horizontal direction that is away from the corresponding shaft 51*c* (i.e., fulcrum point), whereby the angle defined between the above-described fulcrum-load line and the above-described surface-parallel line is reduced from an angle θ to an angle θ' (see FIG. 5). As a result of the reduction of this angle, a direction of the pivot motion of each pivot member 52 becomes closer to a vertical direction. In view (a) of FIG. 5, a force F0 represents a component of the elastic force F2, which is parallel to the direction of the pivot motion of each pivot member 52, in a stage shown in this view (a) of FIG. 5. In view (b) of FIG. 5, a force F0' represents the component of the elastic force F2', which is parallel to the direction of the pivot motion of each pivot member 52, in a stage shown in this view (b) of FIG. 5. Further, a force F1 represents a vertical component of the force F0 (see view (a) of FIG. 5), and a force F1' represents a vertical component of the force F0' (see view (b) of FIG. 5). The vertical component forces F1, F1', each corresponding to a pressing force by which the holder 71 is pressed upwardly by the transmission mechanism 50, can be substantially the same in amount, as shown in FIG. 5, in spite of change of the elastic force generated by the coil spring 54. The relationship between the vertical component force F1 and the elastic force F2 is represented by the following expression:

$$F1=F2\cdot\sin\theta\cos\theta\ (\because \sin\theta=F0/F2,\ \cos\theta=F1/F0)$$

Where the above-described angle θ is not larger than 45°, the reduction of the angle θ leads to the increase of the elastic force F2 generated by the coil spring 54 and also to a reduction of sin θ cos θ. That is, as the angle θ is reduced, a ratio of the vertical component force F1 to the elastic force F2 is reduced. It is therefore possible to keep the above-described pressing force (by which the holder 71 is pressed upwardly by the transmission mechanism 50) substantially constant in spite of the increase of the elastic force F2 that is caused by the reduction of the angle θ. The cam portion 53*a* has the cam profile that is tuned such that the holder 71 is pressed by the substantially constant pressing force F1 while contact of the cam portion 53*a* with the contact surface 71*b* is being maintained during the pivot motion of the pivot member 52.

Figure 6:
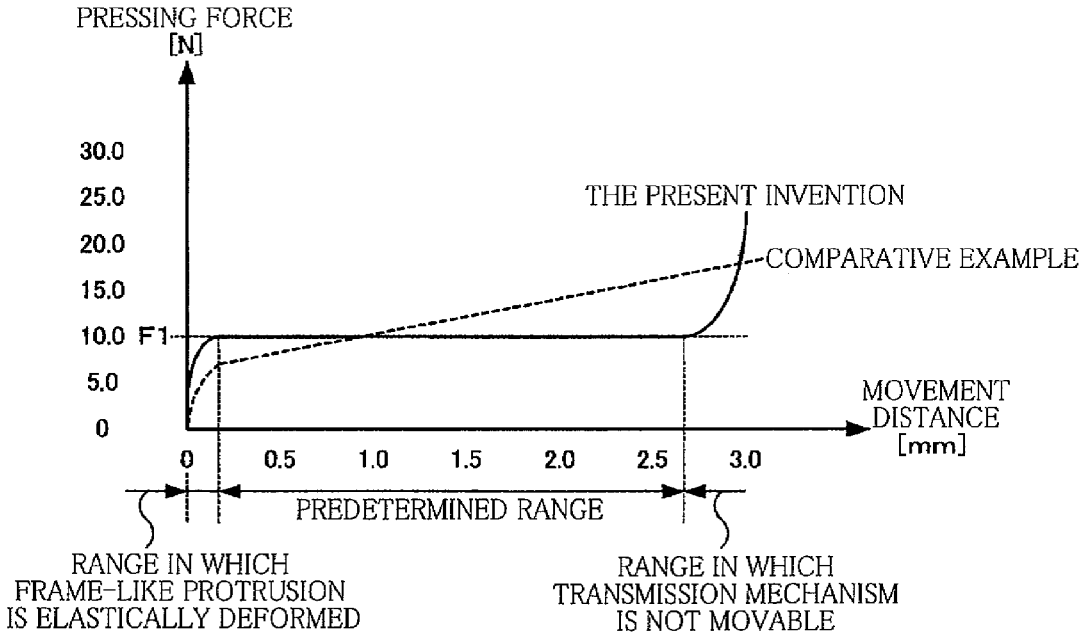
FIG. 6 is a graph showing change of a pressing force, which is transmitted through the transmission mechanism to a cap structure included in the capping unit, in the operation of the capping unit.

FIG. 6 is a graph where its abscissa represents a distance of upward movement of the fixture plate 77 while its ordinate represents the pressing force by which the holder 71 is pressed upwardly by the transmission mechanism 50. The movement distance of the fixture plate 77 is measured from a position (indicated by zero in the abscissa of the graph) in which the cap member 72 is brought into contact with the nozzle opening surface 2*a*. Further, the graph of FIG. 6 indicates also a relationship between the movement distance of the fixture plate 77 and the pressing force in a conventional capping device. In the conventional capping device, a coil spring is provided in place of the transmission mechanism 50. As shown in the graph of FIG. 6, in the present invention, the movement distance and the pressing force are in a proportional relationship in a stage in which the movement distance is larger than zero and smaller than a predetermined range. In this stage, the frame-like protrusion 72*b* is elastically deformed by an amount that is increased with increase of the movement distance, so that the pressing force is increased with increase of the movement distance. Then, in a stage in which the movement distance is in the predetermined range, the pressing force is kept substantially in an appropriate amount F1. That is, the transmission mechanism 50 including the cam portion 53*a* is constructed such that, in this stage, the nozzle opening surface 2*a* can be capped by the cap member 72 by substantially the appropriate amount F1 of the pressing force as a constant amount of the pressing force, even with increase of the movement distance.

Thus, the transmission mechanism 50 is configured to transmit, to the holder 71, the pressing force that is applied to the pressing-force receiving portion as a result of pressing of the nozzle opening surface 2*a* onto the cap member 72, and to restrain increase and reduction of the pressing force such that the transmitted pressing force is held substantially in the appropriate amount F1. It is noted that, in a stage in which the movement distance is larger than the predetermined range, namely, in a stage in which the transmission mechanism 50 is not movable (i.e., in which the pivot members 52 of the transmission mechanism 50 are not pivotable), the movement distance and the pressing force are again in a proportional relationship. In this stage, actually, the frame-like protrusion 72*b* is further elastically deformed, and the pressing force acting on the nozzle opening surface 2*a* is excessively increased. On the other hand, as shown in the graph of FIG. 6, in the conventional capping device, the vertical movement distance and the pressing force are in a proportional relationship, irrespective of whether the movement distance is large or small. Therefore, in the conventional capping device, the movement distance has to be accurately controlled to establish an appropriate amount F1 of the pressing force. That is, in the conventional capping device, where the cap member is supported by a cap-member support member such as a cap holder, the cap-member support member has to be accurately positioned in a capping position.

There will be described the capping operation, which is carried out when the inkjet printer 1 is not operated or when the printer 1 waits to be operated for executing a printing operation. The capping operation is carried out for capping or covering the nozzle opening surfaces 2*a* with the cap members 72 so as to prevent increase of viscosity of the ink within the nozzles. As described above, during the printing operation, the capping device 60 is positioned in a non-capping position (i.e., non-operating position) that is located on a rear side of the inkjet heads 2 (as seen in FIG. 1). Upon initiation of the capping operation, the four inkjet heads 2 are moved upwardly by the frame movement mechanism (not shown). Then, the capping device 60 is moved, by the tray movement mechanism (not shown), to a capping position in which the four capping units 62 are opposed to the respective four inkjet heads 4. Then, the four inkjet heads 2 are moved downwardly by the frame movement mechanism.

Figure 7:
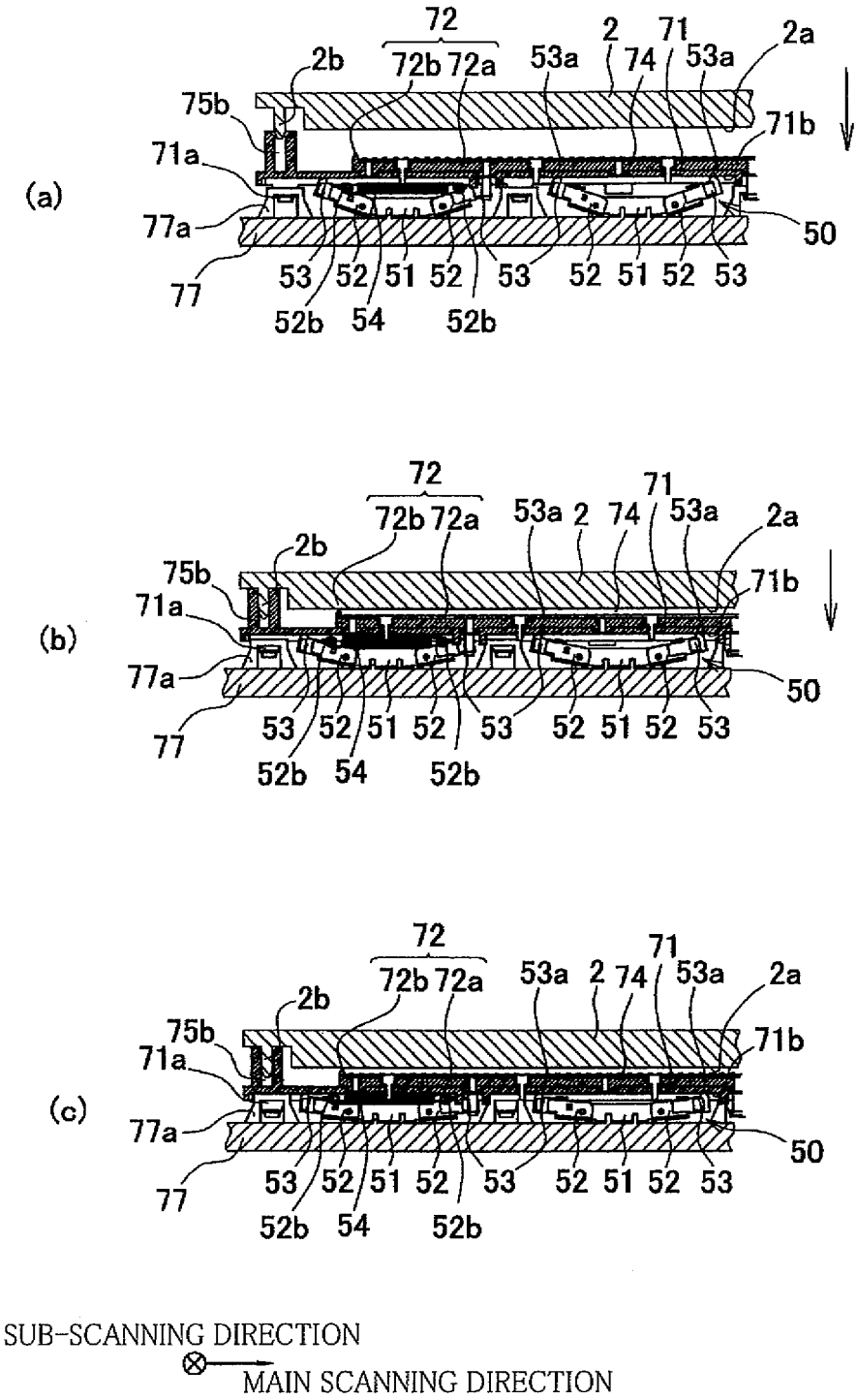
FIG. 7 is a set of views showing an operation of the capping unit.

FIG. 7 is a set of views showing respective stages of the capping operation. As shown in view (a) of FIG. 7, when the four inkjet heads 2 are moved downwardly, the positioning pins 2*b* of the inkjet heads 2 are introduced into the respective positioning holes 75*a*, 75*b* of the holder 71, whereby the cap members 72 can be accurately positioned in respective positions that enable the nozzle opening surfaces 2*a* to be capped or covered by the cap members 72. Then, as shown in view (b) of FIG. 7, when the four inkjet heads 2 are further moved downwardly, the distal end of the respective frame-like protrusions 72*b* are brought into contact with the nozzle opening surfaces 2*a*. In this instance, the distal end portions of the respective frame-like protrusions 72*b* are elastically deformed in a contact direction (i.e., in the vertical direction in which the cap members 72 are movable relative to the nozzle opening surfaces 2*a*) so as to be brought into close contact with the nozzle opening surfaces 2*a*, whereby the nozzle opening surfaces 2*a* are capped or covered by the respective cap members 72. Then, as shown in views (b) and (c) of FIG. 7, when the four inkjet heads 2 are further moved downwardly with the distal end portions of the respective frame-like protrusions 72*b* being elastically deformed, each cap member 72 is pressed onto the corresponding nozzle opening surface 2*a*, and the bottom surface of the fixture plate 77, which serves as the pressing-force receiving portion, receives the pressing force as a reaction of the pressing force applied from the nozzle opening surface 2*a* to the cap member 72. Thus, the holder 71 is moved downwardly whereby the distance between the contact surface 71*b* of the holder 71 and the fixture plate 77 is reduced. In this instance, the pair of pivot members 52 of the transmission mechanism 50 are pivoted in respective directions away from each other, whereby the lengths of the respective coil springs 54 are increased.

The elastic force of each of the coil springs 54 is increased with increase of the length of the coil length 54. The pair of pivot members 52 are pivoted in respective directions away from each other such that the inclination of the above-described fulcrum-load line with respect to the nozzle opening surfaces 2*a* is reduced (wherein the spring supporting portion 52*b* serves as the effort point, the shaft 51*c* serves as the fulcrum point, and the point at which the cam portion 53*a* is in contact with the contact surface 71*b* serves as the load point). By the pivot motions of the pivot members 52, the cam portions 53*a* are slidingly moved relative to the contact surface 71*b*, such that the holder 71 is pressed upwardly by the pivot members 52 by the pressing force F1 that is substantially constant.

In the embodiment constructed as described above, during the capping operation, the transmission mechanism 50 is configured to restrain increase and reduction of the pressing force that is applied to the cap member 72, so that it is possible to cause the cap member 72 to be held in stable contact with the nozzle opening surface 2*a* by the pressing force F1 that is held in a given amount range. Owing to this arrangement, it is possible to restrain the cap member 72 from being in contact with the nozzle opening surface 2*a* by an excessively increased pressing force and to accordingly prevent the cap member 72 and the nozzle opening surface 2*a* from being deformed to abnormal states. Further, it is possible to avoid insufficiency of the pressing force and to reliably establish a sufficient degree of tightness between the cap member 72 and the nozzle opening surface 2*a*.

In the above-described embodiment, the transmission mechanism 50 has the pair of pivot members 52 which are opposed to each other (in the main scanning direction) and which are connected to each other via the coil springs 54. Each of the coil springs 54 is arranged to force the pivot members 52 in respective directions that cause the load points (provided by the cam portions 53*a* of the respective pivot members 52) to be displaced toward each other. Thus, owing to the simple construction, i.e., the combination of the pivot members 52 and the coil springs 54, it is possible to restrain fluctuation of the pressing force that is transmitted to the holder 71, namely, keep the pressing force constant, since the pivot members 52 are pivoted such that a cap-structure-direction force component (transmitted through the pivot members 52 and acting in a direction toward the cap structure) is reduced with increase of the elastic force applied from the coil springs 54 to the pivot members 52. Further, since the pressing force can be evenly applied to the holder 71 via the load points which correspond to the contact points at which the respective pivot members 52 are in contact with the contact surface 71*b*, the pressing force applied from the transmission mechanism 50 to the holder 71 can be further stabilized.

Further, in the above-described embodiment, the fulcrum-load line and the surface-parallel line cooperate to define therebetween the angle that is not larger than 45°, wherein the spring supporting portion 52*b* serves as the effort point, wherein the fulcrum-load line passes through the fulcrum point (corresponding to the shaft 51*c*) and the load point (at which the cam portion 53*a* is in contact with the contact surface 71*b*), wherein the surface-parallel line passes through the load point and the point which lies on the parallel plane and which is the closest to the fulcrum point, and wherein the parallel plane contains the load point and is parallel with the nozzle opening surface 2*a*. Owing to this arrangement, when the distance between the holder 71 and the fixture plate 77 is being reduced, the pivot members 52 can be pivoted reliably in respective directions that cause the cap-structure-direction force component (transmitted through the pivot members 52 and acting in the direction toward the cap structure) to be reduced. Thus, the transmission mechanism 50 can be activated within a range in which the mechanism is geometrically balanced.

Further, in the above-described embodiment, the cam portions 53*a* having given curved surfaces are provided in distal end portions of the respective contact members 53, and the pivot members 52 are in contact at the cam portions 53*a* with the holder 71. Owing to this arrangement which requires merely an inexpensive construction with provision of the cam portions 53*a*, when the pivot members 52 are being pivoted, the fluctuation of the pressing force can be reduced by the contact of the cam portions 53*a* with the contact surface 71*b* of the holder 71, which contact enables the pivot members 52 to be smoothly pivoted.

Further, in the above-described embodiment, each of the capping units 62 has the total of four transmission mechanisms 50 that are arranged in the main scanning direction in which each of the nozzle opening surfaces 2*a* is elongated. Owing to this arrangement, the pressing force can be efficiently applied to entirety of the holder 71 via an increased number of load points which are distant from one another in the main scanning direction.

Further, in the above-described embodiment, since the cap member 72 is an elastically deformable member, it is possible to establish a high degree of followability of the cap member 72 with respect to configuration of the nozzle opening surface 2*a*. That is, even if the elongated nozzle opening surface 2*a* has a poor flatness due to its warp, for example, the distal end portion of the frame-like protrusion 72*b* can be brought into close contact with the elongated nozzle opening surface 2*a*, owing to suitable deformation of the bottom plate 72*a* of the cap member 72. Further, since the pressing force whose amount is substantially constant can be applied evenly to the elongated nozzle opening surface 2*a*, the elongated nozzle opening surface 2*a* can be stably covered by the cap member 72. This technical advantage is available as long as there are a plurality of load points through which the pressing force is to be transmitted to the cap member 72 and the pressing force transmitted to the cap member 72 is held in a given amount range in spite of variation of position in which the pressing force is to be transmitted. That is, the pressing force F1 can be applied evenly to the entirety of the cap member 72 even if the elongated nozzle opening surface 2*a* has a poor flatness as long as the flatness is not larger than a size of the above-described predetermined range shown in the graph of FIG. 6, and the nozzle opening surface 2*a* can be reliably covered with the cap member 72 with the pressing force F1 which is kept constant while the upward movement distance of the fixture plate 77 is within the above-described predetermined range shown in FIG. 6.

Further, in the above-described embodiment, the cap structure is constituted by the cap member 72 and the holder 72 as the reinforcement member which supports the cap member 72, so that it is possible to prevent the cap member 72 from being excessively deformed.

Further, in the above-described embodiment, when the nozzle opening surface 2*a* is capped by the cap member 72, the cam portions 53*a* of the pivot members 52 are positioned in respective positions that are opposed to the frame-like protrusion 72*b* of the cap member 72, so that the pressing force can be efficiently applied to the frame-like protrusion portion 72*b*, whereby the frame-like protrusion portion 72*b* can be reliably brought into contact with the nozzle opening surface 2*a*.

Moreover, in the above-described embodiment, the distal end portion of the frame-like protrusion 72*b* is elastically deformable in above-described the contact direction, so that the frame-like protrusion portion 72*b* can be reliably brought into close contact with the nozzle opening surfaces 2*a*.

In addition, in the above-described embodiment, the fixture plate 77 is made of a resin material so that the capping unit 62 as a whole can be made light in weight.

Figure 8A:
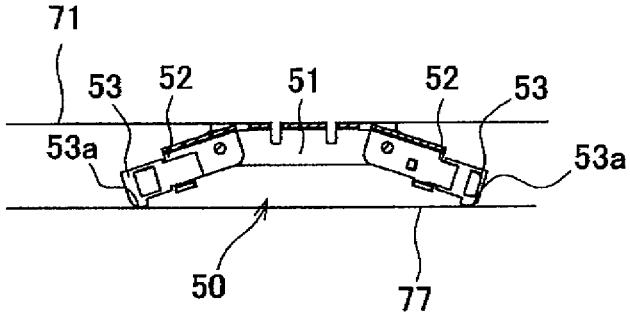
FIG. 8A is a view showing a modification of the transmission mechanism.

While the presently preferred embodiment of the present invention has been described above in detail, it is to be understood that the invention is not limited to the details of the above-described embodiment, but may be embodied with various modifications, without departing from the scope of the invention defined in the claims. For example, while each of the transmission mechanisms 50 is fixed to the fixture plate 77 in the above-described embodiment, each transmission mechanism 50 may be fixed to the holder 71 as shown in FIG. 8A. In this modified arrangement, the cam portions 53*a* of each transmission mechanism 50 are held in slidable contact with the fixture plate 77. It is noted that each transmission mechanism 50 does not necessarily have to be fixed to the fixture plate 77 but may be simply disposed on the fixture plate 77.

Figure 8B:
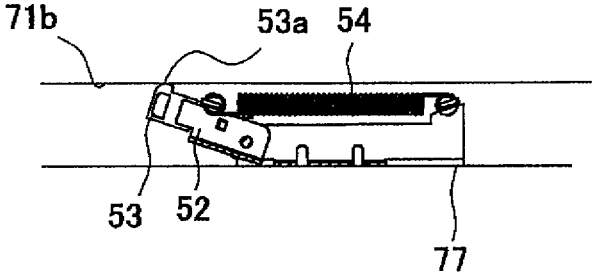
FIG. 8B is a view showing another modification of the transmission mechanism.

In the above-described embodiment, each transmission mechanism 50 is constituted by the pair of pivot members 52 and the coil springs 54 interconnecting the pair of pivot members 52. However, the construction of each transmission mechanism 50 may be modified as needed. For example, the pivot members 52 may be biased or forced by respective springs that are different from each other. Further, each transmission mechanism may be constituted by a single pivot member 52 and the coil spring or springs 54 that bias or force the single pivot member 52, as shown in FIG. 8B. Further, each transmission mechanism may include a spring unit that is a combination of a plurality of springs having respective spring constants that are different from each other, such that the pressing force applied to the holder 71 is not changed depending on the distance between the holder 71 and the fixture plate 77.

In the above-described embodiment, when the nozzle opening surface 2*a* is capped by the cap member 72, the above-described fulcrum-load line and the above-described surface-parallel line cooperate to define therebetween the angle that is not larger than 45°. However, this angle may be larger than 45°.

In the above-described embodiment, the cam portion 53*a*, which is provided in the distal end portion of each contact member 53, has a given cam profile. However, the cam portion 53*a* may have any desired shape such as a simple curved shape. Further, the cam portion 53*a* may be provided by a roller member or a ball member that is rotatably held in each contact member 53 so that it is possible to reduce a resistance acting against the slide movement of the cam portion 53*a* on the constant surface 71*b* of the holder 71.

In the above-described embodiment, each capping unit 62 includes the four transmission mechanisms 50 arranged in the main scanning direction in which the nozzle opening surface 2*a* is elongated. However, the number of the transmission mechanism or mechanisms 50 included in each capping unit 62 may be one, two, three or more than four. Further, the plurality of transmission mechanisms 50 may be arranged in any desired pattern.

In the above-described embodiment, the entirety of the cap member 72 is made of an elastic material. However, only a part of the cap member 72 may be made of the elastic material.

Further, in the above-described embodiment, the present invention is applied to the inkjet printer 1. However, the present invention is applicable also to an apparatus having a liquid ejection head that is configured to eject a liquid other than the ink.

Moreover, in the above-described embodiment, the present invention is applied to the capping device that is configured to cap or cover each nozzle opening surface 2*a*. However, the present invention is applicable to a capping device that is configured to cap or cover a surface of an object, which is other than the nozzle opening surface 2*a*.

What is claimed is:

1. A capping device comprising:

a cap structure that is to be movable, relative to an object, in a contact direction toward a surface of the object so as to be brought into contact with the surface, for thereby covering the surface of the object;

a transmission mechanism configured to transmit, to said cap structure, a pressing force that causes said cap structure to be brought into contact with the surface; and a support member that supports said transmission mechanism; and wherein said transmission mechanism is configured to restrain increase and reduction of the pressing force, such that the pressing force transmitted to said cap structure is held in a given amount range at least when a distance between said cap structure and said support member in the contact direction is in a given distance range while said cap structure is in contact with the surface, wherein said transmission mechanism includes:

a pivot member held by a shaft that is fixed relative to one of said cap structure and said support member, and pivotable about an axis of said shaft that is parallel with the surface of the object, said transmission mechanism being configured to change the distance between said cap structure and said support member when said pivot member is pivoted about the axis while said pivot member is in contact with the other of said cap structure and said support member; and an elastic member that forces said pivot member to be pivoted in a direction that increases the distance between said cap structure and said support member, wherein said elastic member forces said pivot member by an elastic force that is increased as an inclination of a fulcrum-effort line with respect to the surface of the object is reduced by pivot movement of said pivot member, the fulcrum-effort line passing through a fulcrum point and an effort point, the fulcrum point being an intersection of the axis and said pivot member, the effort point being a point at which the elastic force is applied to said pivot member from said elastic member, and wherein said pivot member pivots about only a single shaft.

2. The capping device according to claim 1, wherein said support member includes a pressing-force receiving portion at which the pressing force is to be received by said support member.

3. The capping device according to claim 1, wherein said transmission mechanism includes two pivot members, and wherein said elastic member forces each one of said two pivot members to be pivoted in a direction that causes the effort point at which the elastic force is applied to said each one of said two pivot members, to be moved toward the effort point at which the elastic force is applied to the other of said two pivot members.

4. The capping device according to claim 1, wherein a fulcrum-load line and a surface-parallel line cooperate to define therebetween an angle which is not larger than 45° while said cap structure is in contact with the surface of the object, the fulcrum-load line passing through the fulcrum point and a contact point at which said pivot member is in contact with said other of said cap structure and said support member, the surface-parallel line passing through the contact point and a fulcrum closest point which lies on a plane containing the contact point and parallel to the surface and which is closest to the fulcrum point.

5. The capping device according to claim 1, wherein said pivot member includes a cam portion having a given cam profile, and is in contact at said cam portion thereof with said other of said cap structure and said support member.

6. The capping device according to claim 1, comprising a plurality of transmission mechanisms each provided by said transmission mechanism, wherein said cap structure is elongated in a given direction, for thereby covering the surface that is elongated in the given direction, and wherein said plurality of transmission mechanisms are arranged in the given direction.

7. The capping device according to claim 6, wherein said cap structure includes a cap member that is to be brought into contact with the surface of the object, and wherein said cap member is an elastically deformable member.

8. The capping device according to claim 7, wherein said cap structure includes, in addition to said cap member, a reinforcement member that is attached to said cap member for thereby reinforcing said cap member, and wherein each of said plurality of transmission mechanisms is in contact with said reinforce member, for thereby transmitting the pressing force to said cap member.

9. The capping device according to claim 1, wherein said cap structure has a bottom plate portion and a frame-like protrusion portion which protrudes from said bottom plate portion and which is to be brought into contact with the surface of the object, and wherein said pivot member includes a contact portion, which is in contact with said cap structure while said contact portion is being located in a position that is opposed to said frame-like protrusion portion of said cap structure in said contact direction.

10. The capping device according to claim 1, wherein said cap structure has a bottom plate portion and a frame-like protrusion portion which protrudes from said bottom plate portion and which is to be brought into contact with the surface of the object, and wherein said frame-like protrusion portion of said cap structure is elastically deformable in said contact direction.

11. The capping device according to claim 1, wherein said support member is a member made of a resin.

12. The capping device according to claim 1, wherein said cap structure is to be brought into contact with, as the surface of the object, an ejection- outlet opening surface of a liquid ejection head in which ejection outlets open such that liquid is to be ejected from the liquid ejection head through the ejection outlets.

13. A liquid ejection apparatus comprising:

a liquid ejection head including an ejection-outlet opening surface in which ejection outlets open such that liquid is to be ejected from said liquid ejection head through said ejection outlets;

the capping device recited in claim 1, such that said cap structure is to be brought into contact with said ejection-outlet opening surface as the surface of the object; and each of at least one of said liquid ejection head and said support member being movable relative to the other of said liquid ejection head and said support member in the contact direction.

* * * * *